US005177821A

United States Patent [19]

Kawtoski

[11] Patent Number: 5,177,821

[45] Date of Patent: Jan. 12, 1993

[54] BED SHEETS

[76] Inventor: Susan G. Kawtoski, 6701 Landis Mill Rd., CenterValley, Pa. 18034

[21] Appl. No.: 811,365

[22] Filed: Dec. 20, 1991

[51] Int. Cl.[5] ..... A47G 9/02

[52] U.S. Cl. ..... 5/497; 5/482

[58] Field of Search ..... 5/497, 495, 496, 498, 5/482, 500, 502

[56] References Cited

U.S. PATENT DOCUMENTS 2,695,414 11/1954 Ford et al. ..... 5/497
3,789,441 2/1974 Weiss ..... 5/497
3,857,124 12/1974 Hadley ..... 5/496
3,962,739 6/1976 Crockett ..... 5/497

*Primary Examiner*—Alexander Grosz
*Attorney, Agent, or Firm*—Staas & Halsey

[57] ABSTRACT

A bed sheet combination, including a fitted bed sheet that is a rectangular interlocked cotton knitted fabric, wherein each corner of the rectangle is rounded and an elastic member is sewn around the periphery of the sheet to bunch up the corners, and a top sheet made of the same material, cut at the corners of one transverse side and an elastic member is attached to the transverse side and up a portion of the longitudinal sides extending therefrom, thus creating a billowy area at the bottom of the sheet to loosely receive feet.

3 Claims, 2 Drawing Sheets

BED SHEETS

BACKGROUND OF THE INVENTION

This invention relates to bed sheets and, more particularly, to reversible, longer wearing bed sheets.

Conventional bottom or "fitted" sheets include a generally rectangular piece of percale, a woven material, wherein each of the four corners is cut, stitched to form a seam and elastic is stitched to the border.

Conventional top or "flat" sheets are used on top of fitted sheets and are rectangular pieces usually also made of percale. The corners are not cut and no elastic is used. However, sides may be hemmed by stitching an overlapped piece of edge. Three of the sides of the rectangle are tightly tucked-in between the box spring and the mattress to give the top sheet its characteristic flat appearance.

The drawbacks associated with these conventional fitted and flat sheets follow. Under stress the corner seams eventually tear, thereby rendering the sheet unusable even though the fabric may still be good. The stress on the seams is increased, of course, when the cotton sheet shrinks due to repeated washing and drying or because the depth of the mattress is such that the conventional sheet does not adjust thereto.

Conventional fitted and flat sheets are not intended to be reversible because the various corner and edge stitching has one finished side and an opposite unfinished side. Lacking reversibility only one side of the sheet gets worn and is then usually discarded.

The flat sheet is also deemed by many people to be restrictive or uncomfortable, especially for feet movement. Percale is a non-giving or non-expandable fabric. In an effort to get more room, some people pull the tucked-in end of the flat sheet out from between the mattress and box spring.

Other sheets have been developed where corner seams have been omitted. However, such sheets usually rely on one or more draw strings to constrict the sheet edges around the mattress. Such draw strings are very difficult to use with the usual mattress, create extra bulk, and complicate washing and ironing. Also, said sheets are not usually reversible.

SUMMARY OF THE INVENTION

It is a purpose of the present invention to provide bed sheets that are longer wearing than conventional sheets.

It is another purpose of the present invention to provide bed sheets that are easier to apply or remove than conventional sheets as well as adjust to mattress size and stay in place while in use.

It is another purpose of the present invention to provide a bed sheet which is more comfortable for the user throughout all seasons of the year.

To achieve the foregoing and other purposes of the present invention there is provided a fitted sheet which starts out as a rectangular piece of knitted, interlock cotton fabric. Each corner of the rectangle is rounded and an elastic member is sewn around the periphery of the sheet to bunch up the corners. There are no corner seams. A top sheet also starts out as a rectangular piece of interlock fabric. The corners only at one end are cut and an elastic member is attached to one transverse side and the adjacent sides but only up about 1½ ft. This creates a billowy or expandable area at the bottom of the flat sheet to loosely receive feet. Again, no corner seams are used.

The benefits to the sheet combination of the present invention are that there are no longer any corner seams to tear, the sheets are reversible, and an area is formed for loosely receiving the feet.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

Figure 1:
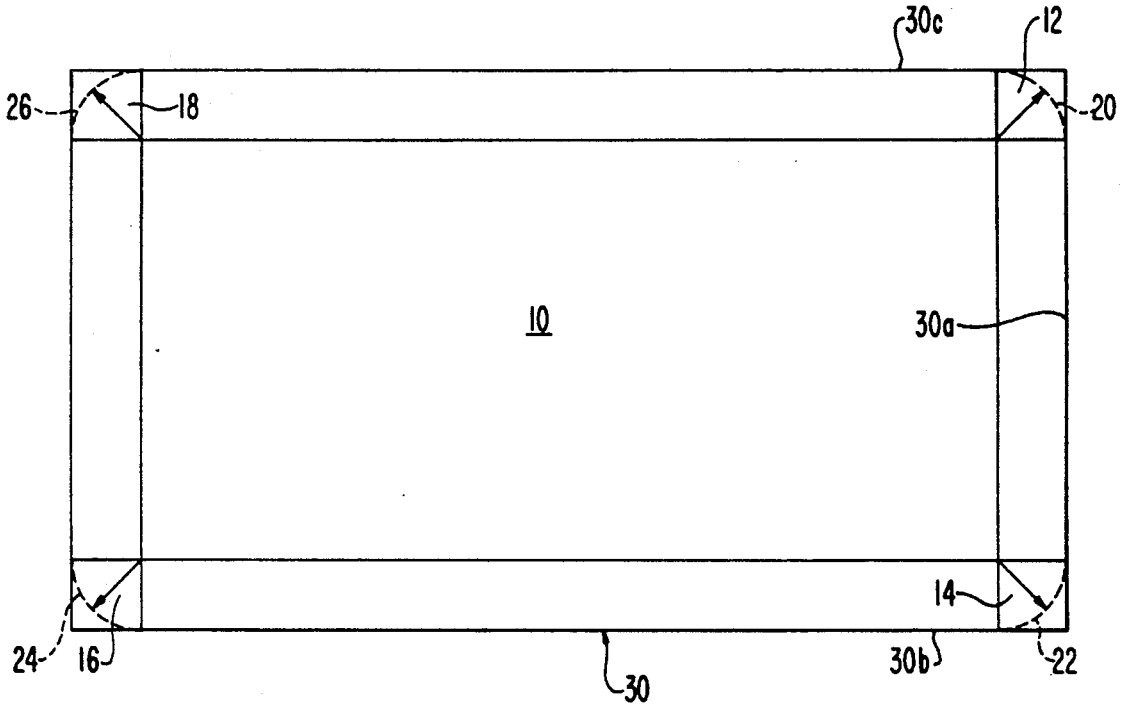
FIG. 1 is a top view of a rectangular piece of interlock fabric with the corners to be cut indicated in phantom.

FIG. 1 is a top view of a piece of fabric used to make the sheets according to the present invention. The piece of fabric is generally referred to by reference numeral 10. The piece of fabric 10 lacks any corner seams, even in its finished form.

The piece of fabric 10 is rectangular and the size thereof is dictated generally by the size of the mattress for which it is intended, i.e., bassinet, crib, twin, double, queen or king. More particularly, a conventional bassinet mattress is 33–35" long, 20–22" wide and about 2–3" high. The size of the piece of fabric 10 for a fitted sheet according to the present invention is 37½" L by 24" W. For a standard crib mattress 52" L by 28" W, the fabric 10 for the fitted sheet is 68" L by 44" W. For a twin mattress 75" L by 38" W, or 74" L by 39" W, the fabric 10 would be 95" L by 54" W for the fitted and 87" L by 54" W for the top. For a double mattress 74" L by 54" W, the fabric for the bottom would be 94" L by 70" W and for the top 86" L by 70" W. For a queen 80" L by 60" W mattress, the bottom starts out as 100" L by 76" W and the top 92" L by 76" W. Finally, for a conventional king-size mattress 80" L by 78" W, the fabric 10 for the bottom is 100" L by 98" W and for the top, 92" L by 98" W. The sheets for the crib through king sized mattresses are intended to receive mattress thicknesses of about 4–8", with about 2" of fabric extending under the mattress.

As noted above, conventional sheets are made of material such as cotton or percale which are woven relatively rigid, non-giving, materials. In contrast, the piece of fabric 10 is 100% knitted interlock cotton. Such fabric 10 stretches or "gives", i.e., is relatively expandable. The rectangular piece of fabric 10, of course, includes four corners 12, 14, 16 and 18.

In order to produce a bottom fitted sheet according to the present invention, all four seamless corners 12, 14, 16 and 18 are cut along curved lines 20, 22, 24 and 26, respectively, to form rounded corners 12, 14, 16 and 18. More particularly, a line can be drawn along each side 8 inches in from each side. A radius is cut 8 inches outward from the intersection of each two lines. To make a bassinet sheet, the measurement is 4" since the thickness of the bassinet mattress is about one-half that of the crib, twin . . . king mattresses described above.

Figure 2:
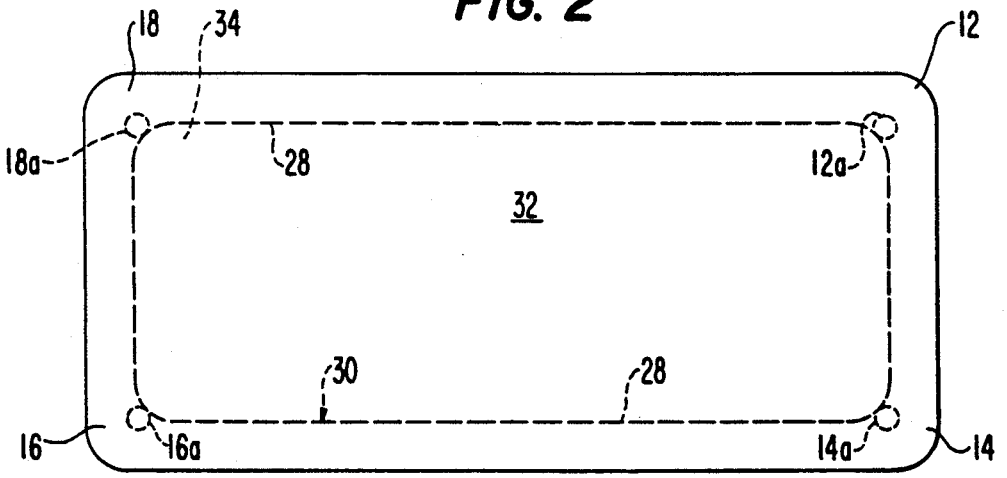
FIG. 2 is a top view of a fitted bottom sheet formed according to the present invention as applied to a mattress.

Thereafter, conventional elastic material 28 is stitched to an entire edge 30 of the piece of fabric 10, including the rounded corners 12, 14, 16 and 18, as shown in FIG. 2, thereby gathering the corners.

Since the corners are not easily identifiable, and to facilitate applying and removing the sheets, loops of fabric such as twill tape can be applied to the elastic 28 as shown at reference numerals 12*a*, 14*a*, 16*a* and 18*a*. Labels could also be used. The loops are not seen when the sheet is in use.

To make a top sheet according to this invention, only corners 12 and 14 are rounded by cutting at lines 20, 22, respectively, as described above. Then elastic material 28*a* is stitched to the side 30*a* and about 1½ ft. up the edges 30*b* and 30*c* of the piece of fabric (See FIG. 4). The remaining corners 16, 18 remain pointed, and the remainder of the edge 30 of the piece of fabric 10 lacks any elastic. Preferably, a separate piece of the fabric is cut and applied cross grain to the transverse side between the corners 16 and 18. For mattresses other than king, a nine inch wide piece of fabric is used, folded over and stitched to form a 4½" finished border 19. For a king, the fabric is twelve inches wide, folded over to form a six inch finished border 19. The cross grain helps to prevent stretching at the transverse side between the corners 16 and 18, the head end of the mattress. Of course, a conventional hem could also be formed on the top sheet if desired.

It is believed "flat" would be a misnomer for the top sheet according to the present invention. Because one end thereof includes cut and elasticized corners at one end, it is not truly a flat sheet. However, once applied to the mattress, this top sheet looks just like a conventional flat sheet.

FIG. 2 also shows the completed fitted sheet 32 applied to a mattress 34. As can be seen, the elasticized edges 30 pull the corners 12, 14, 16 and 18 inward around the mattress 34 so that the sheet 32 appropriately fits the mattress.

Figure 3:
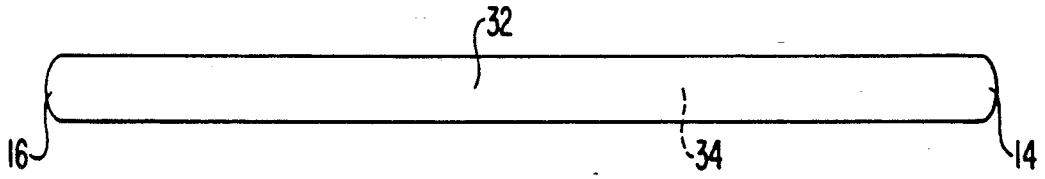
FIG. 3 is a side view of the fitted sheet according to the present invention on a mattress.

FIG. 3 is a side view of the fitted sheet 32 applied to the mattress 34, showing the form fit of the sheet 32.

Figure 4:
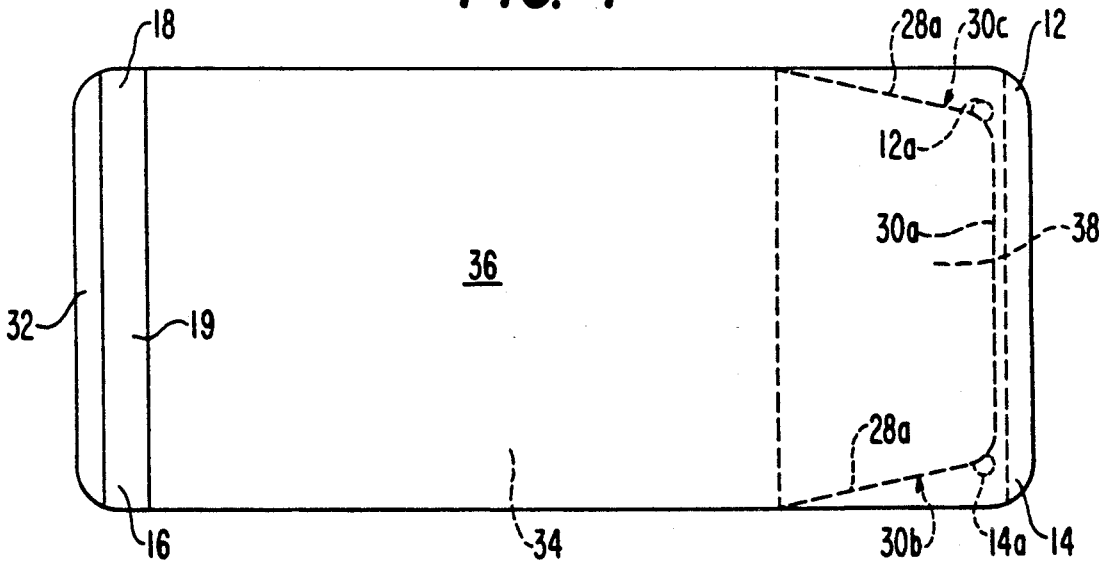
FIG 4 is a top view of a top sheet formed according to the present invention as applied to a mattress.

FIG. 4 also shows the top sheet 36 applied over the fitted sheet 32 and the mattress 34. The elasticized corners 12, 14, as well as the elasticized edges 30*a*, 30*b* and 30*c*, are fit under one end of the mattress 34. The rest of the top sheet 36 rests on top of the mattress 34 and along its sides.

Due to the two corners 12, 14 being elasticized, as well as the expandable fabric, an area 38 is formed at one end of the top sheet 36 which "gives" or is somewhat expandable to provide more room and comfort for the feet. (See FIG. 4) This extra space for the feet created by area 38 does not result in the usual pulling out of the tucked-in end of the sheet.

Because these bottom fitted and top sheets include no seams, there is no likelihood of a tear forming at the corners. Eliminating tears results in a longer, useful life for the sheets.

As noted above, corner seams are eliminated, but the sheets may include other seams, for example the interlocked fabric is not available in wide enough stock to use a unitary piece for double queen or king sized sheets. As a result, a longitudinal seam may be necessary. The seam would be finished on both sides to promote reversibility. Also, seams at other than the corners may be used for added strength, or a sporty look.

Further, since there are no drawstrings or finished side seams to be concerned with, both these sheets are reversible. Reversibility allows even wear on both sides of the sheets and effectively doubles their useful life.

Also, since the type of fabric used gives, more comfortable sheets are provided, especially for the feet.

Further, unlike the sheets using drawstrings which are very difficult to apply, remove, wash and care for the sheets of the present invention are applied, removed, washed and cared for just like conventional sheets.

Finally, due to the fabric and elastic used the present sheets are self-adjusting. That is, the sheet, once placed over the mattress, gathers itself under the mattress.

The foregoing is considered illustrative only of the principles of the invention. Further, since numerous modifications and changes will readily occur to those skilled in the art, it is not desired to limit the invention to the exact construction and operation shown and described. For example, although sheets are described above, the present invention is equally applicable to any other mattress cover, mattress pad, blanket, box spring cover or comforter. Also, the present invention is intended to be used as waterbed sheets. Accordingly, all suitable modifications and equivalents may be resorted to that fall within the scope of the invention and the appended claims.

Finally, since the elastic is expandable, and to a lesser extent the fabric, these fitted and flat sheets can be used with any normal mattress size.

What I claim is:

1. A bed sheet combination, comprising:

reversible, top and bottom sheets of expandable fabric and having seamless corners, the bottom sheet being rectangular with substantially parallel lateral and substantially parallel longitudinal sides and four corners defined at the intersections of said lateral and longitudinal sides, said corners being rounded, wherein the rounded corners and the lateral and longitudinal sides of the bottom sheet define a periphery to which an elastic material is continuously attached; and the top sheet being rectangular with substantially parallel lateral and substantially parallel longitudinal sides and four corners defined at the intersections of said lateral and longitudinal sides, two of said corners adjacent a first lateral side being rounded, wherein said two rounded corners and said first lateral side of the top sheet define a periphery to which an elastic material is continuously attached.

2. A bed cover combination, comprising:

reversible top and bottom bed covers of expandable fabric and having seamless corners, the bottom cover being rectangular with first, second third and fourth linear sides, said first and third sides being substantially parallel to each other and said second and fourth sides being substantially parallel to each other and each being substantially perpendicular to the first and third sides, and four corners defined at the intersections of said sides, said corners being rounded, wherein the rounded corners and the sides of the bottom cover define a periphery to which an elastic material is continuously attached, and the top cover being rectangular with first, second, third and fourth linear sides, said first and third sides being substantially parallel to each other and said second and fourth sides being substantially parallel to each other and each being substantially perpendicular to the first and third sides, and four corners defined at the intersections of said sides, two of said corners adjacent the first side being rounded, wherein said first side and the two adjacent rounded corners define a periphery to which an elastic material is continuously attached.

3. The sheet as recited in claim 2, wherein the expandable fabric is interlock knitted cotton.

* * * * *